United States Patent [19]

Moser et al.

[11] Patent Number: 4,501,307

[45] Date of Patent: Feb. 26, 1985

[54] MACHINE FOR FILLING AND CLOSING TWO-PIECE HARD GELATINE CAPSULES

[75] Inventors: Theo Moser, Steinenberg; Götz Mader, Korb-Kleinheppach, both of Fed. Rep. of Germany

[73] Assignee: Robert Bosch GmbH, Stuttgart, Fed. Rep. of Germany

[21] Appl. No.: 359,330

[22] Filed: Mar. 18, 1982

[30] Foreign Application Priority Data

Mar. 18, 1981 [DE] Fed. Rep. of Germany ..... 3110483

[51] Int. Cl.[3] ..... B65B 1/24

[52] U.S. Cl. ..... 141/258; 141/71; 141/12; 53/560; 222/275

[58] Field of Search ..... 141/1, 5, 6, 11, 12, 141/67, 71, 98, 392, 121, 125, 258, 259, 280; 53/560, 272, 276; 222/370, 346, 350, 275

[56] References Cited

U.S. PATENT DOCUMENTS

| | | | |
|---|---|---|---|
| 2,646,912 | 7/1953 | Reveno | 141/12 X |
| 3,070,932 | 1/1963 | Höfliger | 53/276 |
| 3,324,902 | 6/1967 | Lense | 141/1 |
| 3,874,431 | 4/1975 | Aronson | 141/258 |
| 3,921,681 | 11/1975 | Rebmann et al. | 141/258 |
| 4,106,535 | 8/1978 | Davis | 141/125 |

OTHER PUBLICATIONS

Leaflet "GKF-Filling and Sealing Machine for Hard Gelatine Capsules", by Robert Bosch GmbH, Produktbereich Höfliger + Karg, Waiblingen, W-Germany.

*Primary Examiner*—Stephen Marcus
*Assistant Examiner*—Ernest G. Cusick
*Attorney, Agent, or Firm*—Edwin E. Greigg

[57] ABSTRACT

A machine is proposed for filling and closing hard gelatine capsules, in which the powder to be filled into the capsules is located in a filling product container, the base of which is a revolving dispensing disc. The dispensing disc has openings into which the powder is pressed with the aid of filler punches. A ring is firmly connected with the dispensing disc and has openings for receiving upper capsule portions. Curve controlled elements having openings for receiving lower capsule portions are pivotably disposed on the underside of the ring. The pivoting movement of the elements is effected via a stationary curve and a curved roller. The curve is embodied such that the elements can be moved both outward, that is, beyond the circumference of the ring, and inward, that is, underneath the openings in the dispensing disc.

5 Claims, 3 Drawing Figures

31
32
29
28
30
13
14
III
27
27
12
16
22
26
26
22
11
16
15
18
17
17'
18'
21
20
18''
40
41
17
18
21
20
24
42
25
23

MACHINE FOR FILLING AND CLOSING TWO-PIECE HARD GELATINE CAPSULES

BACKGROUND OF THE INVENTION

In a known apparatus for filling hard gelatine capsules with powder (German Offenlegungsschrift No. 23 22 028), the arrangement is such that the container for the product to be filled is combined with the dispensing disc to make a self-contained unit. The dispensing disc acts as the base of the filling product container, which in turn comprises a jacket, which encompasses the dispensing disc, and a lid, which has apertures through which the stuffing and transfer punches can pass. This apparatus has proved to be generally successful, because it assures that uniform quantities of the powder are introduced into dispensing chambers in such a manner that the product is not harmed, and the product is then transferred into hard gelatine capsules in such a way that a loss of powder is avoided. Furthermore, the embodiment of the dispensing disc and the filling product container as a self-contained unit prevents soiling of the machine, because then no powder can escape. Still further, this arrangement and embodiment of the dispensing disc and filling product container result in a relatively compact structure for the powder filling and stuffing apparatus.

However, when segments receiving the upper and lower parts of the capsules and rotating on a circular track are disposed alongside the dispensing disc having the filling product container, the result is relatively large dimensions for these machines. (See particularly page 3 of a prospectus for GKF filling and sealing machines for hard gelatine capsules, put out by Höfliger + Karg.) The increased space requirement is also a consequence of the fact that frequently pellets or tablets must be filled into the hard gelatine capsules, in addition to the powder. To accomplish this, additional work stations are required, and they must be disposed within the movement range of the segments receiving the lower parts of the capsules.

It would be desirable to have a machine for filling powder into hard gelatine capsules in which the individual elements required for processing the hard gelatine capsules are disposed and associated with one another in such a way that the machine can be realized with significant savings in terms of space as compared with known machines. In so doing, it ought also to be possible to dispose additional work stations in a similarly space-saving manner, so that various variations in filling processes can be performed.

OBJECT AND SUMMARY OF THE INVENTION

The apparatus according to the invention offers the advantage above all of a very compact structure for the machine as a whole, while at least matching the output of previously known machines. A further substantial advantage is found in the fact that the curved-contour control of the segments receiving the lower parts of the capsules provides the opportunity of moving these segments outward in the course of their revolutions, so that the desired additional work stations can likewise be disposed in a space-saving manner within the movement range of the segments.

Further advantageous embodiments of and improvements to the apparatus according to the invention may be attained by means of the characteristics disclosed in the dependent claims.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
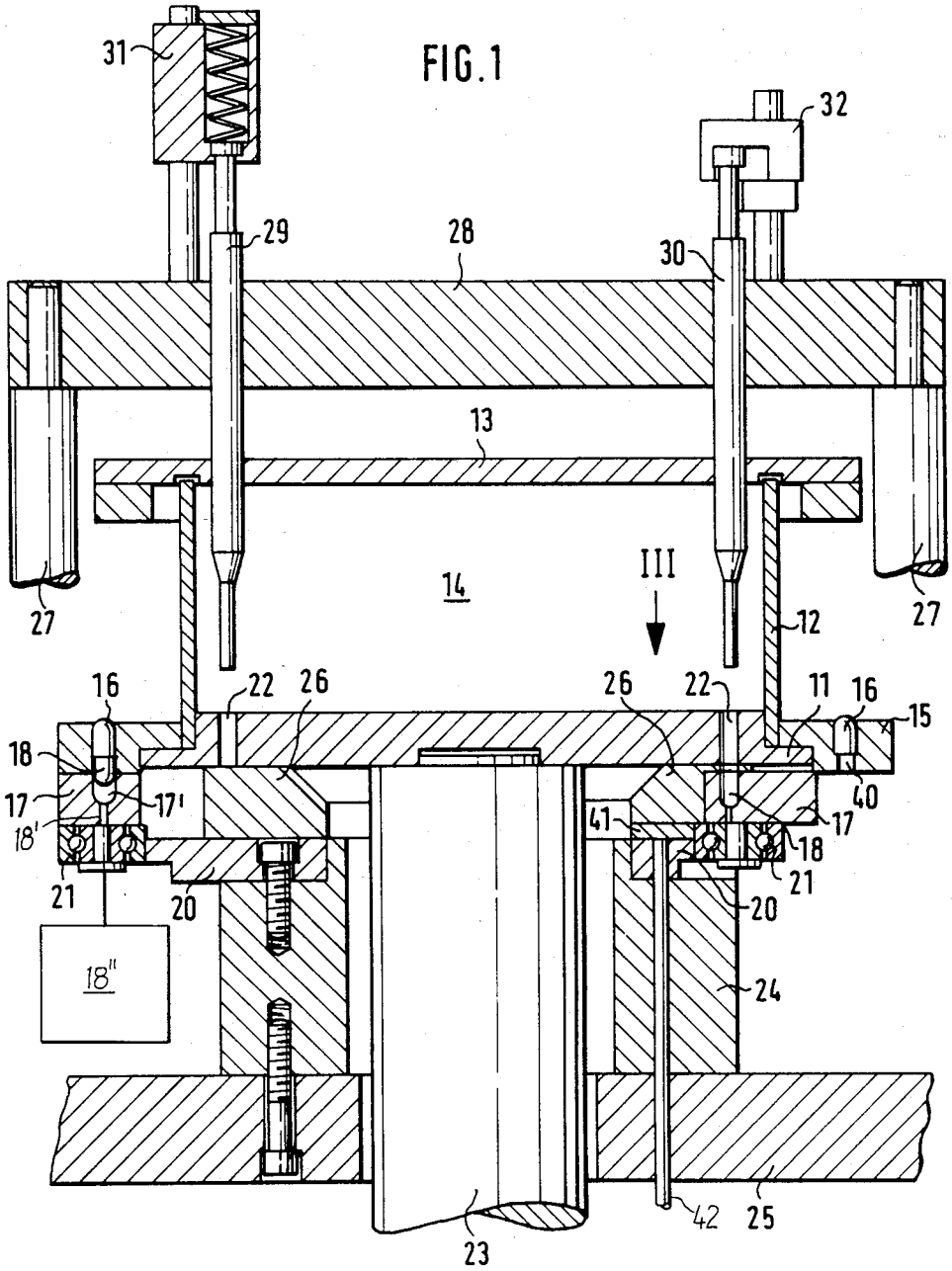
FIG. 1 is a longitudinal cross-sectional view taken through the apparatus according to the invention along the line II—II of FIG. 2.

As is particularly clear from FIG. 1, a ring 15 that serves to receive upper portions 16 of capsules is associated with a dispensing disc 11, which embodies the base of a container 14 for products to be filled, the container also including a jacket 12 and a lid 13. As may also be seen from FIGS. 2 and 3, segments 17 are provided below the ring 15, which are embodied to receive lower portions 18 of the capsules. The segments 17 are supported such that they are pivotable about a bolt 19 secured in the ring 15, and as they revolve they are moved inward or outward, via a curved roller 21 by means of a stationary curved plate 20; depending on what action is required, that is, they are moved inward below apertures 22 of the dispensing disc 11 or outward beyond the circumference of the ring 15. The dispensing disc 11 is secured on a shaft 23, which is connected with a drive mechanism (not shown). A ring 24 surrounds the shaft 23 and is supported on the table 25 of the machine. A plate 20, having a curved perimeter which will be discussed further hereinafter, is positioned on the ring 24. Between the perimeter of the curved plate 20 and the dispensing disc 11, an intermediate ring 26 is provided, which can be pressed in a manner known per se against the underside of the dispensing disc 11 by adjusting means, not shown. This intermediate ring 26 serves to seal off the apertures 22 of the dispensing disc 11 in the area where powder is dispensed. As FIG. 1 further shows, a carrier 28 which can be moved upward and downward by means of columns 27 is disposed above the container 14 for the product to be filled. Filler punches 29 and an expeller punch 30 are guided in the carrier 28. The filler punches 29 are secured in a guideway 31 connected with the carrier 28 and are under the influence of a spring. The guideway 31 is embodied as adjustable, in a known manner, such that the filler punches 29 can be adjusted in accordance with the required amount of powder to be dispensed. The expeller punch 30 is likewise supported in a holder 32 in such a manner that it can be adjusted in height.

Figure 2:
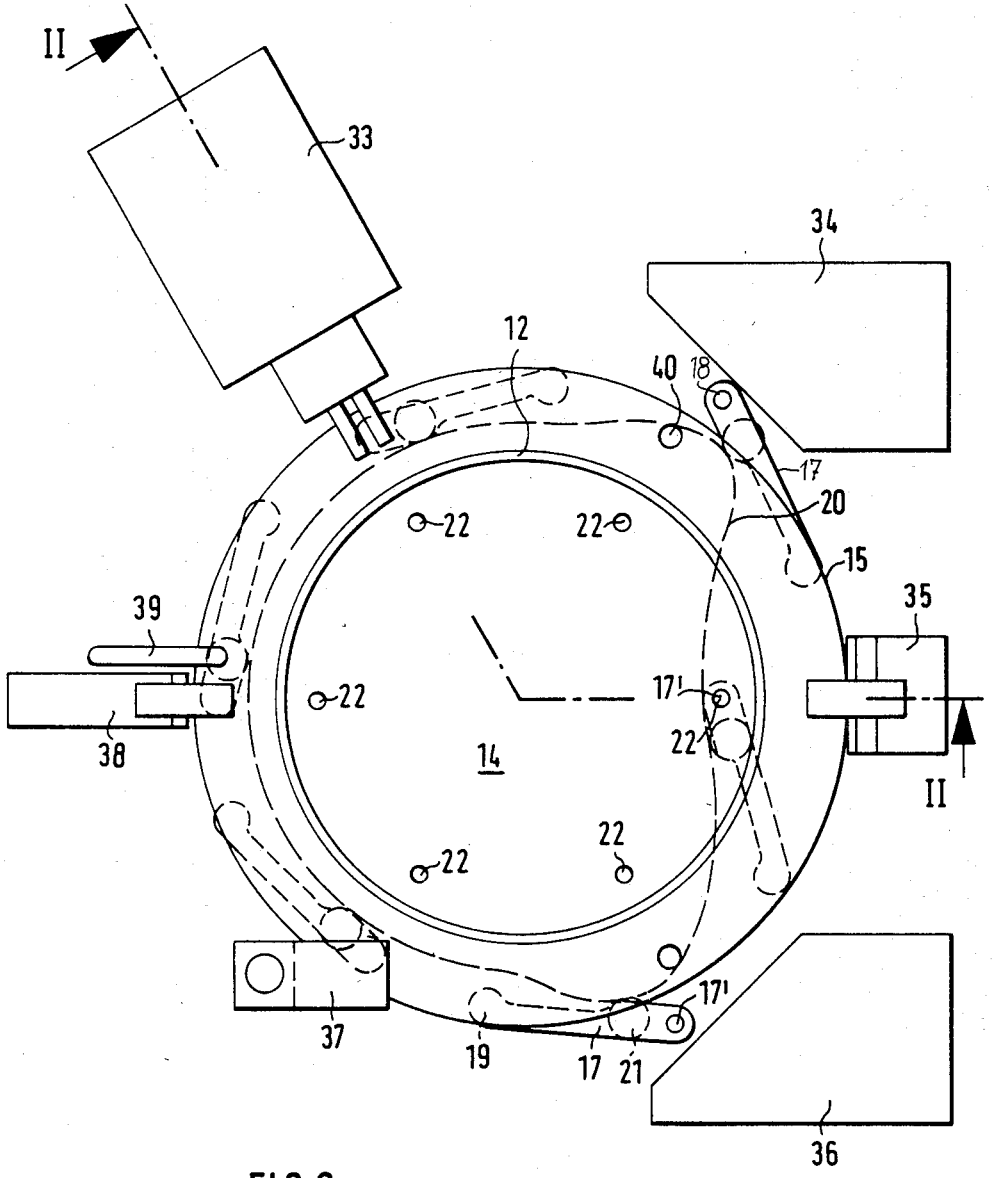
FIG. 2 is a top plan view of FIG. 1.
Figure 3:
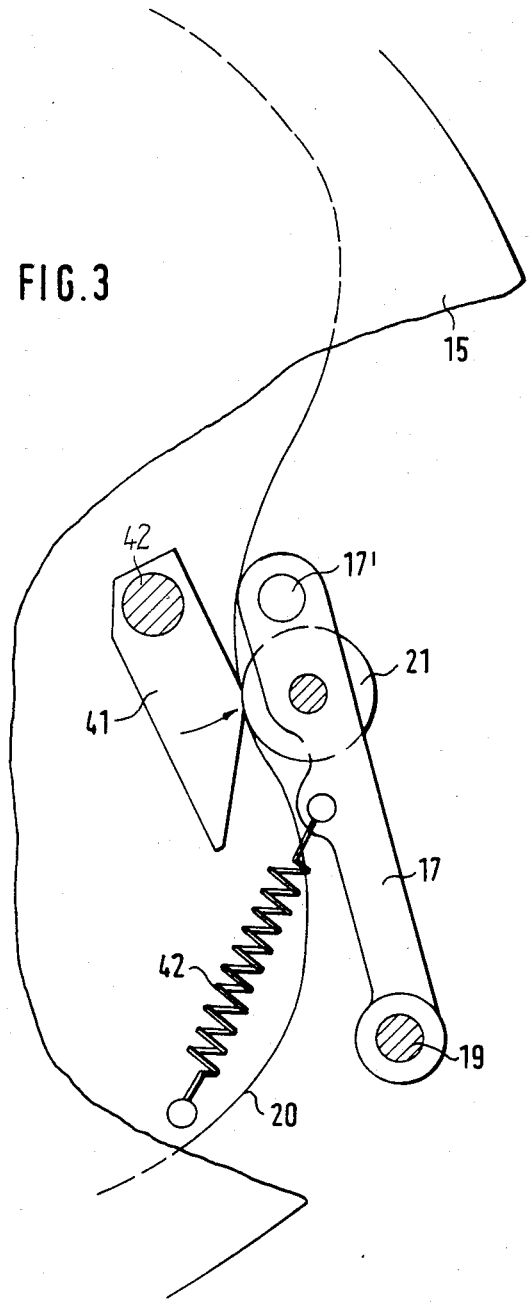
FIG. 3 is a view in the direction of arrow III of FIG. 1, seen partially in section.

As seen particularly in FIG. 2, various processing or work stations are disposed on the circumference of the dispensing disc 11 or on the circumference of the ring 15 secured to the dispensing disc 11. The station 33 serves to effect initial sorting of the capsules and to introduce the capsules into the openings of the ring 15; the upper portions 16 of the capsules remain in the ring 15, while the lower portions 18 of the capsules are introduced into an opening 17' of a segment 17, for instance by aspirated air furnished by 18'' to aperture 18'. Station 34 is an apparatus for the supplementary introduction of pellets or tablets into the hard gelatine capsules. To this end, the segments 17 are moved outward by the curve of plate 20 and the curved roller 21, as shown in FIG. 2. In the vicinity of the processing station 35, the segments 17 are moved inward via the curve 20 and the curved roller 21, so that a lower capsule portion is located below an aperture 22 in the dispensing disc 11. At the same time, defective capsules are also rejected at this processing station 35, and the powder stuffing and wiping mechanism shown in FIG. 3 is disposed in this area as well. The processing station 35 is followed by a work station 36, which serves like the work station 34 to effect the supplementary filling of pellets or tablets. A closing station 37 disposed subsequent to the processing station 36 serves to close the capsules. The final processing station, following the closing station 37, is a capsule expulsion apparatus 38, which is disposed directly following an apparatus 39 for cleaning the capsule receptacles—that is, the openings 17' in the segments 17 and the openings 40 in the ring 15.

The mode of operation of the apparatus according to the invention is as follows:

After being sorted and sent in the proper direction, the capsules are introduced in the vicinity of station 33 into openings 40 of the ring 15. As shown by FIG. 1 in particular, the opening 17' of a segment 17 is then located precisely below the opening 40 in the ring 15. The openings 40 and 17' are embodied such that the upper capsule portion 16 remains in the opening 40, while the lower capsule portion 18 is introduced into the opening 17' of the segment 17. The dispensing disc 11 is now indexed by one increment, so that the corresponding segment 17 is moved outward via the curve of plate 20 and the curved roller 21, as shown in FIG. 2, to the vicinity of the pellet or tablet filling station 34. In this position of the segment 17, it is possible for pellets or tablets to be filled into the lower half 18 of the capsules, should this be required. Upon the next indexing movement of the dispensing disc 11, the segment 17 reaches the area of the processing station 35 in which the powder is filled into the lower half 18 of the capsules. This is effected with the aid of the expeller punch 30, which presses the plug of powder located in an opening 22 of the dispensing disc 11 into the lower half 18 of a capsule. In this position, as may be seen from FIG. 2, this lower half 18 is located precisely below the corresponding opening 22, because the segment 17 has been moved inward via the curve of plate 20 and the curved roller 21. As already noted, the powder stuffing and wiper mechanism shown in FIG. 3 is also located in this area. This mechanism includes a lever 41, which is fastened on the top of a periodically swung upright shaft 42 controlled via means not shown such that, after the powder plug has been introduced into the lower portion 18 of the capsule, the segment 17 is moved away from the curve of plate 20 via the curved roller 21; thus excess powder located between the end of one opening 22 and the filling area of the lower half 18 of the capsule is wiped away. As FIG. 3 further shows, each segment 17 is pressed against the curved perimeter of plate 20 by a spring 42. It is also possible to provide a defective-capsule rejection apparatus in the vicinity of station 35; this apparatus is well known and accordingly requires no further description in the context of the present invention. After the dispensing disc 11 has been indexed farther, the segment 17 reaches the area of a further pellet or tablet filling station 36. At this station, if desired, further pellets or tablets can be added to the powder previously filled into the capsules. Instead of the pellet or tablet filling station 36, any other processing station which may be required can also be provided, so long as the filling of pellets and tablets at station 34 is sufficient. In the area of the pellet and tablet filling station 36, the curve of plate 20 is embodied such that the segments are moved outward via the curved roller 21, as in the area of the station 34. The next indexing step of the dispensing disc 11 carries the lower capsule portions 18 into the area of the closing station 37. The curve of plate 20 is embodied in this area such that one openings 17' of the segment 17, and thus one lower capsule portion 18, are located below one opening 40 of the ring 15 and accordingly below one upper capsule portion 16. Now the lower capsule portion 18 is driven upward by known means, so that it is recombined with the upper capsule portion 16. Upon the further indexing of the dispensing disc 11, the segment 17 reaches the area of the capsule expulsion station 38, where the position of the segment 17 in the area of the closing station 37 is maintained by means of appropriately embodying the curve of plate 20. After the capsules are expelled in the area of the capsule expulsion station 38, the openings 40 in the ring 15 and the openings 17' in the segments 17 are cleaned. The next indexing step of the dispensing disc 11 moves the segments 17 back into the vicinity of the station 33, in which a new delivery of sorted empty capsules takes place.

The apparatus described above for filling powder into hard gelatine capsules or the like relates to a machine driven incrementally, and segements 17 are provided which each have an opening 17' for receiving one lower half 18 of a capsule. The apparatus according to the invention may, however, also be so embodied that the segments 17 have a plurality of openings 17' for the simultaneous reception of a plurality of lower capsule portions 18. Naturally, a corresponding number of openings 22 will then be provided in the dispensing disc 11 as well, and a corresponding number of filler punches 29 and expeller punches 30 will also be required. The apparatus can furthermore be so embodied that the dispensing disc 11 and thus all the parts connected to the dispensing disc 11 revolve continuously.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A machine for filling and closing hard gelatine capsules, wherein a container having powder therein includes means for pressing said powder into openings for forming preformed charges of powder in a revolving dispensing disc positioned beneath said container, means for pushing the preformed charges of powder as blanks through said disc into portions of capsules, means positioned beneath said disc having at least one recess for holding a lower capsule portion, said container comprising a jacket which surrounds said dispensing disc, a lid for said container, said lid having apertures for said pressing and pushing means, characterized in that said dispensing disc comprises a ring for revolving with said disc and provided with means for receiving an upper capsule portion, and wherein said means positioned beneath said disc comprises at least one curve-controlled element for displacing said recess for holding said lower capsule portion.

2. A machine as defined by claim 1, characterized in that said curve-controlled element is arranged to pivot to and fro so as to move from a position beneath said dispensing disc outwardly toward said ring thereof and visa versa.

3. A machine as defined by claim 2, characterized in that said curve controlled element is arranged to cooperate with a stationary cam device positioned in proximity to said dispensing disc for effecting said displacement.

4. A machine as defined by claim 1, characterized in that said curve controlled element is arranged to cooperate with a stationary cam device positioned in proximity to said dispensing disc for effecting said displacement.

5. A machine as defined by claim 1, characterized in that said curve controlled element further includes means supported by said last named element which cooperates with further means arranged to wipe excess powder from and lower capsule portion.

* * * * *